United States Patent [19]

Stock et al.

[11] 4,102,598

[45] Jul. 25, 1978

[54] SINGLE CASE LOW PRESSURE TURBINE

[75] Inventors: Alvin L. Stock, Nether Providence Township, Delaware County; Gravatt K. Roddis, Media; William C. Nygren, Middletown Township, Delaware County, all of Pa.

[73] Assignee: Westinghouse Electric Corp., Pittsburgh, Pa.

[21] Appl. No.: 630,870

[22] Filed: Nov. 11, 1975

[51] Int. Cl.[2] ..... F01D 25/26; F01D 25/24

[52] U.S. Cl. ..... 415/135; 415/219 R

[58] Field of Search ..... 415/100, 101, 102, 103, 415/108, 135, 136, 219 R, 217, 134, 138, 139

[56] References Cited

U.S. PATENT DOCUMENTS

| | | | |
|---|---|---|---|
| 884,058 | 4/1908 | Wellman | 415/103 |
| 935,438 | 9/1909 | Westinghouse | 415/103 |
| 1,082,741 | 12/1913 | Ferranti | 415/135 |
| 1,369,667 | 2/1921 | Junggren | 415/135 |
| 1,410,644 | 3/1922 | Bentley | 415/135 |
| 1,529,925 | 3/1925 | Say | 415/100 |
| 1,691,184 | 11/1928 | Froy | 415/103 |
| 2,282,894 | 5/1942 | Sheldon | 415/136 |
| 2,777,665 | 1/1957 | Martinson | 415/134 |
| 2,841,362 | 7/1958 | Yeomans | 415/108 |
| 3,529,901 | 9/1970 | Hart et al. | 415/103 |
| 3,594,095 | 7/1971 | Trassel et al. | 415/134 |
| 3,610,770 | 10/1971 | Hendriks | 415/103 |
| 3,640,639 | 2/1972 | Ruhl | 415/219 R |
| 3,892,500 | 7/1975 | Miller et al. | 415/219 R |
| 3,942,907 | 3/1976 | Meylan | 415/219 R |

FOREIGN PATENT DOCUMENTS

| | | | |
|---|---|---|---|
| 344,600 | 11/1921 | Fed. Rep. of Germany | 415/219 R |
| 110,556 | 10/1925 | Switzerland | 415/135 |

*Primary Examiner*—William L. Freeh
*Attorney, Agent, or Firm*—J. W. Keen

[57] ABSTRACT

A low pressure turbine apparatus having a single casing member surrounding a rotatable member. The casing comprises six pieces which, when joined, provide an integrated single casing member. Suitable flex plates are provided to accommodate differential thermal expansion of the casing yet avoid thermal distortion of the apparatus. The stationary blading and inlet and extraction flow spaces are incorporated in a center section. Exhaust hood end sections with integral bearing housings are bolted to the center section through vertical joints. Axial brace pipes integral with the center section tie the end sections together and prevent movement of the bearings due to expansion of the higher temperatures in the inlet and extraction zones. Axial alignment of the stationary blading is provided at the center plane of the turbine by the use of integrally fabricated flex plates. The center section is insulated and exposed to atmospheric conditions. There is a separate condenser connection for each exhaust hood end section, and extraction pipe connections are made in an open atmospheric zone.

8 Claims, 3 Drawing Figures

SINGLE CASE LOW PRESSURE TURBINE

BACKGROUND OF THE INVENTION

1. Field of the Invention

This invention relates to low pressure turbine apparatus, and, in particular, to a low pressure turbine apparatus having a single casing member.

2. Description of the Prior Art

In the prior art, the typical casing arrangement for a low pressure turbine apparatus comprises a plurality of nested cylinders disposed concentrically about each other. Whether utilized in a single or a double flow turbine, the casing usually includes an inner cylinder No. 1, an inner cylinder No. 2, and an outer cylinder. Each cylinder has, as is well known, a mating cover and base portion.

Inner cylinder No. 1 confines and guides the pressurized motive steam over alternating arrays of rotatable and stationary blading to convert the energy carried thereby into rotating mechanical energy. Inner cylinders No. 1 and No. 2 have as their purpose the isolation of high temperatures and prevention of high temperature gradients, to thus reduce thermal distortions and thermal strains. The nested outer cylinder permits axial expansion of the inner cylinders without affecting the position of the bearing members which support the turbine rotor.

Although the current low pressure casing construction admirably meets all the aforementioned objectives, the disposition of such a large number of major components has a major impact on the cost of the turbine. Presently, there are at least ten major components required in a typical low pressure casing. These elements include an inner cylinder No. 1 cover, an inner cylinder No. 1 base, an inner cylinder No. 2 cover, an inner cylinder No. 2 base, an outer cylinder center section cover, an outer cylinder center section base, and, disposed axially in each side of the center section, an outer cylinder end section cover, and, an outer cylinder end section base. The number of major pieces requiring machining is many. In addition, there is required suitable support and alignment features to permit free movement of the parts due to differential thermal expansion. Further, suitable pressure sealing arrangements must be provided wherever steam inlet connections or steam extracting connections pass through each of the nested cylinders. Since the hotter inner cylinder is exposed to cooler steam on its outside surface, in order to limit thermal gradients, a thermal shield about the innermost inner cylinder No. 1 may also be required.

It is apparent, then that it is desirable to provide a casing for a low pressure turbine having a reduced number of necessary major pieces. As a concomitant to the reduction in number of pieces, the cost of the casing is reduced, due to a reduction in both labor and material costs. At the same time, it is desirable to reduce the number of major pieces, yet maintain reliability and increase the ease of fabrication of the turbine.

SUMMARY OF THE INVENTION

This invention discloses a single casing, low pressure turbine apparatus. By single casing it is meant that there is provided no separated inner, concentric cylinders disposed within an outer turbine casing as in the prior art. The single casing comprises center section base, a corresponding and mating center section cover, and an end section base and corresponding cover disposed on each axial side of the center section. Stationary blading and inlet and extraction zones are disposed within the center section. Jointure of the corresponding base and cover portions and axial attachment of center and end sections provides an integrated single casing which confines and guides motive steam within the low pressure turbine. Suitable means are provided to permit controlled thermal expansion and maintain axial alignment of the connected sections.

It is an object of this invention to simplify fabrication and reduce manufacture cost of a low pressure turbine casing yet, at the same time, maintain reliability and integrity of the casing structure. It is another object of this invention to provide a low pressure turbine casing requiring minimal number of major sections. It is a further object of this invention to provide a low pressure turbine casing having no separate inner cylinders or separate alignment and support features appertunant therewith. Other objects of this invention will be made clear in the following detailed description.

BRIEF DESCRIPTION OF THE DRAWINGS

The invention will be more fully understood from the following detailed description of a preferred embodiment taken in connection with the accompanying drawings, in which.

DESCRIPTION OF THE PREFERRED EMBODIMENT

Figure 1:
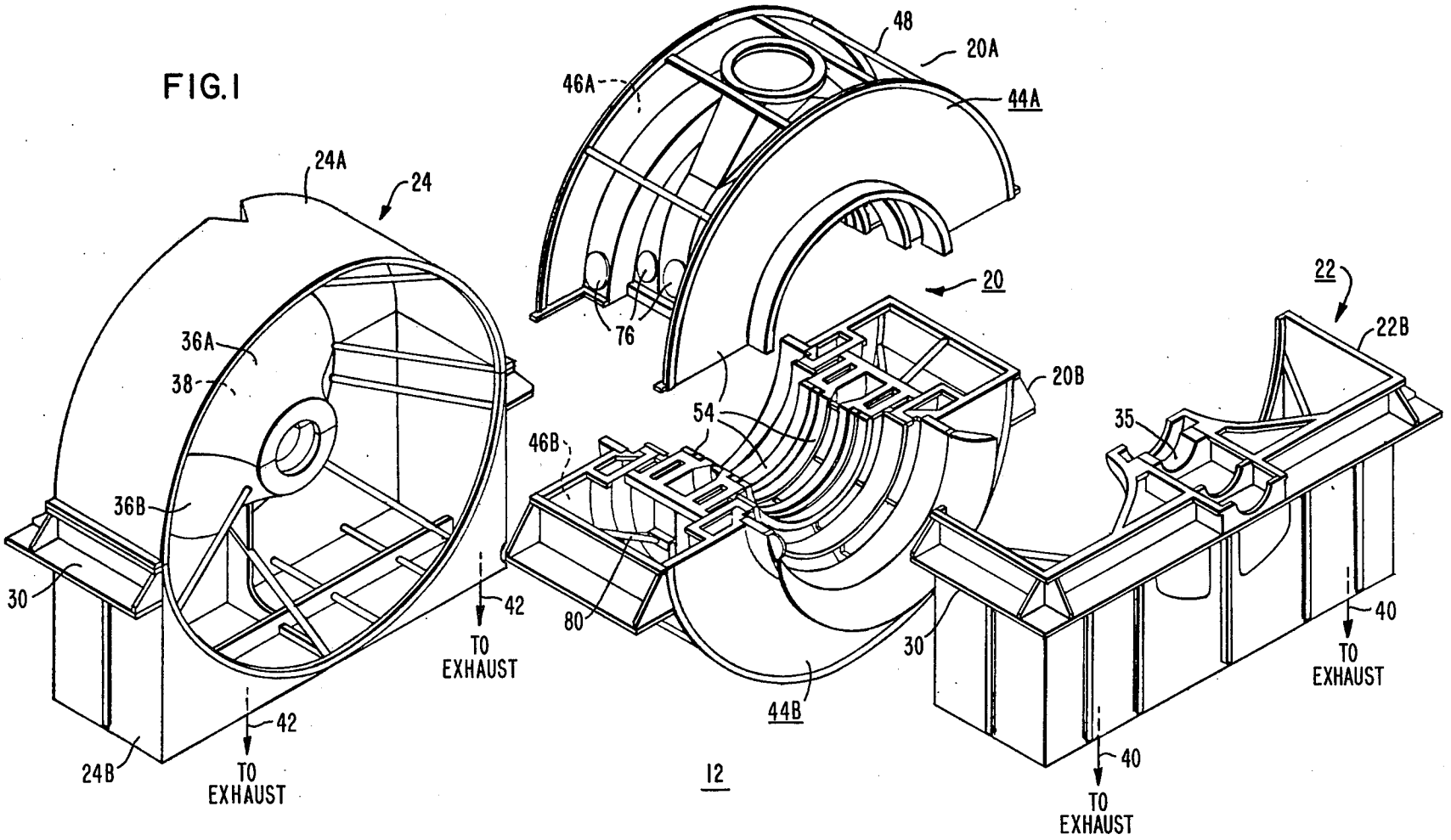
FIG. 1 is an exploded view, in perspective, of a single casing low pressure turbine having no separate inner cylinders and embodying the teachings of this invention.

Throughout the following description, similar reference characters refer to similar elements in all Figures of the drawings.

Figure 2:
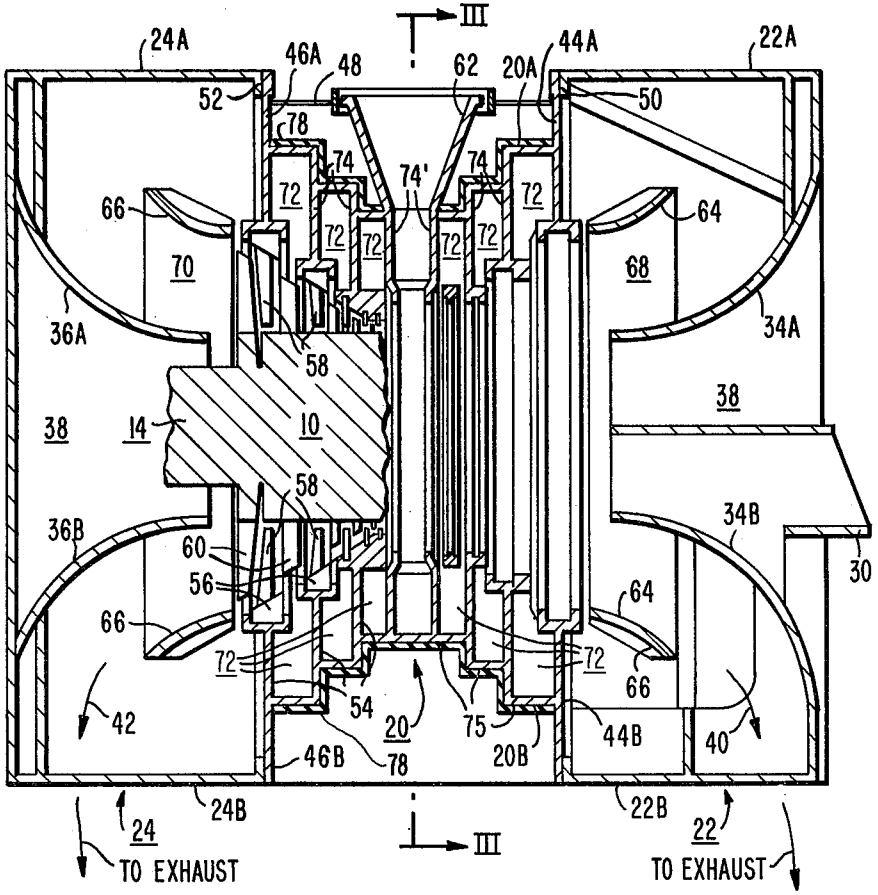
FIG. 2 is a longitudinal sectional view of a single casing low pressure turbine apparatus utilizing the teachings of this invention; and, FIG. 3 is a transverse section view of a turbine apparatus embodying the invention taken along section lines III—III of FIG. 2.

Referring to FIGS. 1 and 2, there is shown, respectively, an exploded view, in perspective, and a longitudinal section view of a low pressure turbine apparatus 10 having a single casing, generally indicated by reference 12 embodying the teachings of this invention. In FIG. 1, those constituent elements which comprise the casing 12 and which will be explained in more detail herein are shown in isolation while FIG. 2 illustrates the assembled relationship of the turbine 10 in which the casing 12 surrounds and supports a rotatable member 14. Although the Figures disclose a double flow turbine 10, it is understood that the casing 12 described herein is useful for any low pressure turbine. According to the Figures, the casing 12 comprises three conjoined sections, namely, a center section, generally indicated by reference numeral 20, and two axial end sections 22 and 24 connected to each axial side of the center section 20.

The three conjoined sections 20, 22 and 24 comprise a total of six major elements. More specifically, the center section 20 is itself comprised of a center section cover 20A and a center section base 20B, while first end section 22 is comprised of an end section cover 22A (not shown in FIG. 1) and an associated base 22B. Similarly, the second end section 24 is comprised of an end section cover 24A similar to member 22A and a corresponding end section base 24B. It may be appreciated that the turbine casing 12 embodying the teachings of this invention is disposed in the fully assembled state when the six major elements mentioned are joined along their horizontal center lines and along their transverse mating surfaces to provide an integrated casing structure for the low pressure turbine apparatus 10. In contradistinction to the prior art, the turbine casing 12 embodying the teachings of this invention thus disposes a single cylindrical casing element surrounding the rotatable member 14. In the prior art, it is most common to utilize a concentric arrangement of two or three nested cylindrical members around the rotatable elements. Of course, such a concentric arrangement generates increased cost due to increased materials and labor, and also generates many disadvantageous features which will be described herein and which are eliminated by the casing 12 embodying the teachings herein.

As seen from FIGS. 1 and 2, each end sections 22 and 24 have a support foot 30 disposed on the base portions 22B and 24B, respectively, which engage a suitable foundation (not shown) to securely and firmly support the turbine apparatus 10. The center section 20 may also be provided with support feet. In addition, each end section 22 and 24, has integral therewith matable portions 34A and 34B and matable portions 36A and 36B (shown only on section 24 in FIG. 1) which, when conjoined, define a bearing cone 38. The cones 38 define a space or volume in which are disposed bearing members 35 for the rotatable shaft member 14. By disposing the bearings within the space defined by the bearing cones 38 as close as possible to the center of the rotating element 14, the deleterious condition known as bearing span is reduced as significantly as is possible.

Owing to the single case construction characteristic of this invention, there are two separate connections, shown at 40 and 42, between the exhaust of the low pressure turbine 10 and a condenser element (not shown). In the prior art, the condenser is typically disposed directly beneath the entire axial length of turbine apparatus. As a concomitant to the separate condenser connections 40 and 42, it may be seen from the drawings that the entire center section 20 is accessible at all points.

The center section 20 has annular flex plates 44 and 46 (each also divided along the horizontal centerline to form sections 44A and 44B and 46A and 46B) which define transverse mating surfaces and which, when assembled, define vertical joints 50 and 52 between the center section 20 and its adjoining end sections 22 and 24. The annular end plates 44 and 46 are flexible in a manner and for a purpose to be described herein. Axial bracing members 48 are assembled between the flex plates 44 and 46 to support the attached end sections and maintain the proper axial positioning of the bearings 35 mounted therein.

The center section 20 further provides radial support wall members 54 on which are provided blade rings 56 (FIG. 2) which support annular arrays of stationary blades 58 alternately disposed between annular arrays 60 of rotatable blades mounted on the rotor 14. The radial support wall members 54 may be of the same radial dimension or may, as shown, have increasing radial dimensions progressing toward the flex plates 44 and 46, to provide a stepped configuration.

Motive fluid is introduced to the casing 12 through the inlet channel 62 which protrudes radially beyond the basic diameter of the casing 12 onto alternating arrays of rotatable blades 60 in order to convert the high pressure, high temperature energy of the motive fluid to rotational mechanical energy. At the discharge end of the blade path, flow guides 64 and 66 are provided within each end section 22 and 24 and which when aligned with the interior of the bearing cones sections 34A and 34B and 36A and 36B define diffuser channels 68 and 70 through which the expanded motive fluid is conducted via the separate condenser connections 40 and 42 into the condenser element.

Since the center section 22 confines and guides the motive fluid, the center section 22 becomes heated relative to the end sections 22 and 24. In order to accommodate differential expansion of the center section 22, the flex plates 44 and 46 are, as stated above, flexible to allow axial expansion of the hotter center portion 20 relative to the horizontal center line of the apparatus 10. However, the annular flex plates 44 and 46 are, at the same time, rigid in their own plane, i.e. the transverse vertical plane, and are capable of transmitting torque loads on the blade path to the support feet 30 on the end sections 22 and 24.

Figure 3:
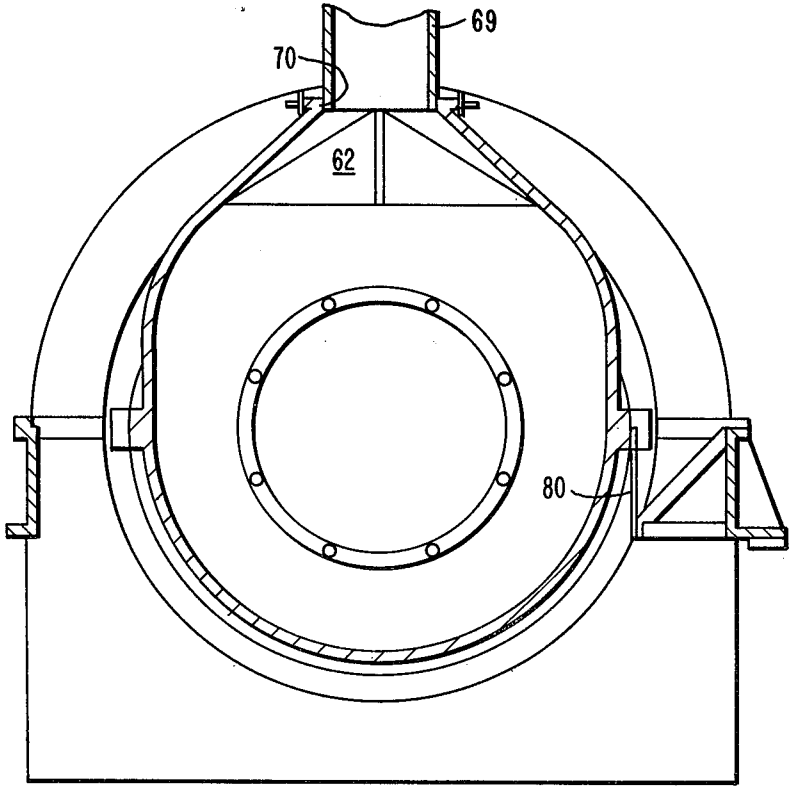

The inlet zone 62 protrudes radially beyond the basic diameter of the casing 12. In the nested cylinder configuration of the prior art, due to the very nature of the nested construction, a restraint on the radial dimension of the inlet zone is imposed. However, with the elimination of the outer concentric cylinders, such a radial extension of the inlet zone 62, as seen in the Figures, may now be easily accomodated. Thus, a more advantageous cross-section may be provided for the inlet zone 62. Referring to FIG. 3, a transverse section taken along section lines III—III of FIG. 2 and illustrating the configuration of the inlet zone 62 is shown. In FIG. 3 the inlet zone 62 has an involute or heart-shaped cross-section configuration which provides approximately constant circumferential velocity for influent steam from the cross-over pipe 69 connection attached at the mouth 70 of the inlet zone 62 to the horizontal center line of the casing 12.

The elimination of the radial size constraint of the prior art has a further advantage. With the abrogation of outer cylinders, extraction zones, such as those defined within the center section and illustrated at 72, may also extend further outward than prior hereto. As a further modification and refinement permitted by the single case construction, and as seen from FIG. 2, the transverse wall arrangement as illustrated at 74 between each of the extraction zones 72 in the center section 20 eliminates the multiple wall junctions present in prior art low pressure cylinders and thereby limits the high temperature drop from the inlet zone 62 across the inlet zone wall 74' to the difference between the steam inlet temperature and the steam temperature at first extraction temperatures. The typical prior low pressure cylinder exposes this junction to the difference between inlet and second and/or third extraction temperatures. This invention has the advantage of limiting thermal strains and increasing cyclic fatigue capability.

Also, the stepping of the center section 20 provides further axial flexibility to the casing 12. Also seen from FIG. 2, since there are two separate condenser connections 40 and 42, the extraction zones 72 are advantageously provided in the open area about the center section 20 and the extraction piping is accessible from the exterior of the apparatus. Since the exterior of the innermost cylinder is no longer swept by high temperature steam, the thermal shield of the prior art has been eliminated. However, since the exterior of the center section 20 is exposed to atmosphere, there is provided a thermal insulating layer 78 to provide a barrier against radial thermal gradients.

Axial positioning of the blade path at the turbine horizontal center line is provided, as seen in FIG. 3, through a series of axial flex plates 80 which are fabricated integrally with the center section 20 and which allow relatively free movement of the radial walls 74 in a circumferential direction due to thermal expansion yet which remain rigid in the axial direction.

In light of the foregoing description, it may be readily appreciated that since all of the multiple cylinders of the prior art have been eliminated and replaced with a single low pressure casing member lifting operations on the entire covering unit to expose the blade path and the rotor are greatly simplified, thus increasing the ease and accessibility of the rotatable elements for repair and maintenance operations.

One skilled in the art may also see that since the arrangement described herein eliminates the concentric inner cylinders, the need for inner cylinder support and alignment features required by the prior art are eliminated. Since the inlet and extraction zones need not pass through a concentric cylinder configuration, the need for thermal shielding for these last-mentioned zones, as well as the inlet and extraction sealing necessary when that piping extended through each of the concentrically disposed cylinders, is also eliminated.

It is also apparent that by utilizing a single casing low pressure turbine apparatus, the cost of manufacturing is significantly reduced in that there are fewer major pieces which require machining operations. Further a single casing lightens the overall weight to be supported by the foundation, thus further increasing savings.

Use of the single casing turbine eliminates the inlet cone of the prior art and, with the involute inlet zone, provides an improved flow distribution as described and shown in FIG. 3. Also, larger extraction zones and extraction connections are directly accessible since provided in the space available beneath the center section 20.

The fatigue capabilities of the radial walls 74 on the stepped wall configuration in the center section is improved in that each wall is subjected to a lesser thermal gradient than in the prior art. Also, the disposition of insulation externally and circumferentially about the extraction wrappers reduces radial temperature gradients in the wrappers 75.

In conclusion, it is thus seen that a single casing low pressure turbine embodying the teachings of this invention results in a simplification of design and an increase in reliability over those casings utilized by the prior art. The disclosure embodied herein eliminates all concentric inner cylinders, inner cylinder alignment features, thermal shielding and extraction and inlet sealing, and at the same time reduces the high cost of fabrication and repair.

What we claim is:

1. A low pressure turbine apparatus comprising:

a rotatable member having blades thereon;

a single casing member surrounding said rotatable member, said single casing member comprising only a center section and axial end sections joined at each axial end of said center section; and flex plates disposed at each axial end of said center section in such manner that when said end sections are joined thereto said flex plates readily deform to allow differential thermal expansion between said center and end sections.

2. The apparatus of claim 1, wherein:

said center section comprises a cover and base member, and each of said end sections comprises a cover and a base.

3. The apparatus of claim 2, wherein there is provided a separate connection to an external condenser element between each end section.

4. The apparatus of claim 3, wherein the exterior of said center section is exposed to the atmosphere.

5. The apparatus of claim 4, wherein an insulating member is disposed about said exterior of said center section.

6. The apparatus of claim 4, wherein said center section has an inlet zone therein bounded by an inlet zone wall, said inlet zone having an involute shaped transverse cross-section portion in fluid communication with an annular, circumferentially disposed portion situated radially inside said involute portion;

said single casing having a basic diameter within which said annular portion's wall extends substantially radially and is arranged to minimize the temperature difference thereacross, while said involute shaped portion extends beyond the basic diameter of the casing and provides a substantially constant circumferential flow rate through said annular portion; and said center section having separate extraction zones of unconstrained radial dimension provided at predetermined locations along the casing's exterior, said extraction zones being directly accessible from the space about said center section.

7. The apparatus of claim 6, wherein there exists a temperature difference across said inlet wall equal only to the difference between the temperature of the inlet steam and the temperature of steam in the first extraction zone.

8. The apparatus of claim 7, wherein a bearing cone is provided in each of the end sections and a flow guide is provided within said center section at each axial end thereof adjacent said end section; said flow guide and said bearing cone defining on the interior of the assembled apparatus a diffuser channel leading to said separate condenser connections.

* * * * *